US008291947B2

(12) United States Patent
Michels

(10) Patent No.: US 8,291,947 B2
(45) Date of Patent: Oct. 23, 2012

(54) WATER BOTTLE ADAPTOR FOR AN APPLIANCE

(75) Inventor: Victor Michels, Delray Beach, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 914 days.

(21) Appl. No.: 12/390,793

(22) Filed: Feb. 23, 2009

(65) Prior Publication Data

US 2009/0218370 A1 Sep. 3, 2009

Related U.S. Application Data

(60) Provisional application No. 61/032,202, filed on Feb. 28, 2008.

(51) Int. Cl.
*B67D 3/00* (2006.01)

(52) U.S. Cl. ..... 141/319; 141/330; 141/364; 222/82

(58) Field of Classification Search ..... 141/319–320, 141/329–330, 363–365; 222/80–83.5
See application file for complete search history.

(56) References Cited

U.S. PATENT DOCUMENTS 1,248,705 A * 12/1917 Pogue ..... 141/330
4,382,402 A 5/1983 Alvarez
4,699,188 A * 10/1987 Baker et al. ..... 141/330
4,846,236 A * 7/1989 Deruntz ..... 141/329
4,941,806 A * 7/1990 Brown et al. ..... 62/397
5,228,601 A * 7/1993 Podesta ..... 222/181.2
5,280,764 A * 1/1994 Levinrad ..... 141/330
5,328,059 A * 7/1994 Campbell ..... 141/346
5,567,322 A * 10/1996 Rundle et al. ..... 222/146.6
5,845,514 A * 12/1998 Clarke et al. ..... 62/373
6,135,427 A 10/2000 Tsai
6,749,181 B1 6/2004 Chen
6,850,698 B1 * 2/2005 Goh ..... 392/403
7,331,487 B2 * 2/2008 Macler et al. ..... 222/83
2006/0226170 A1 * 10/2006 Larsen ..... 222/64

* cited by examiner

*Primary Examiner* — Timothy L Maust
*Assistant Examiner* — Nicolas A Arnett
(74) *Attorney, Agent, or Firm* — Seth M. Blum

(57) ABSTRACT

A system and method for supplying bottled water to an appliance is provided, where the water bottle is opened as it is positioned on the appliance. The appliance includes an operational portion and a bottle receiving portion. The operational portion can be any appliance which utilizes water in its operations, such as humidifiers, vaporizers, coffeemakers, tea makers, dental water jets, and the like. The bottle receiving portion includes a conduit defining a fluid path, where the conduit is in fluid communication with the operational portion. The conduit has a first end with a piercing member for piercing the bottle, and a second end in fluid communication with the operational portion. When a water bottle is positioned in the bottle receiving portion, the piercing member pierces the bottle, allowing the water to exit the bottle along the fluid path to the operational portion of the appliance.

12 Claims, 6 Drawing Sheets

WATER BOTTLE ADAPTOR FOR AN APPLIANCE

CROSS-REFERENCE TO RELATED APPLICATION

This application claims the benefit of U.S. Provisional Application No. 61/032,202 entitled Water Bottle Adapter for an Appliance, filed on Feb. 28, 2008, the contents of which are herein incorporated by reference in its entirety.

FIELD OF THE INVENTION

The present disclosure relates to a system and method for supplying bottled water to an appliance, and more particularly, to a system and method for opening a water bottle positioned on the appliance.

BACKGROUND OF THE INVENTION

Many appliance, such as, humidifiers, vaporizers, coffeemakers, tea makers, dental water jets, and the like, utilized water in their operation. In use, tap water is provided into these devices, where the tap water is either dispersed into the air and inhaled, such as in humidifiers, or ingested, such as in coffee and tea makers. However, tap water typically may include high levels of impurities, which are then also inhaled or ingested by a user(s).

Such impurities can include metals, such as mercury and lead, and other harmful chemicals. During continuous use of the appliances, such impurities can accumulate in the body of the user(s).

Bottled water is a convenient source of water which is substantially free of impurities. When used with the appliances, in place of tap water, the bottled water can substantially decrease the levels of impurities inhaled or ingested by a user(s).

SUMMARY OF THE INVENTION

The present disclosure provides a system and method for supplying bottled water to an appliance, where the water bottle is opened as it is positioned on the appliance. The appliance includes an operational portion and a bottle receiving portion, wherein the water bottle is removable positionable in the operational portion to supply water to the operational portion. The operational portion can be any appliance which utilizes water in its operations, such as humidifiers, vaporizers, coffeemakers, tea makers, dental water jets, and the like.

The bottle receiving portion of the appliance includes a conduit defining a fluid bath. The conduit includes a first end having a piercing member for piercing the bottle, and a second end in fluid communication with the operational portion.

When a water bottle is positioned in the bottle receiving portion, the piercing member pierces the water bottle, allowing the water to exit the water bottle. The water travel through the conduit, along the fluid path, to the operational portion of the appliance.

A support member can be positioned in the bottle receiving portion. The support member is configured to receive the water bottle therethrough, supporting the water bottle in a substantially vertical position. The support member can be made of an elastic material, such that it can expand to receive different size water bottles.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The present disclosure provides a system and method for supplying bottled water to an appliance, where the water bottle is opened as it is positioned on the appliance. The water bottle can be positioned on the appliance in an inverted position, such that a cap on the water bottle is pierced to provide water to the appliance. Alternatively, the water bottle can be positioned on the appliance in an upright position, such that the bottom of the water bottle is pierced to provide water to the appliance.

Figure 1:
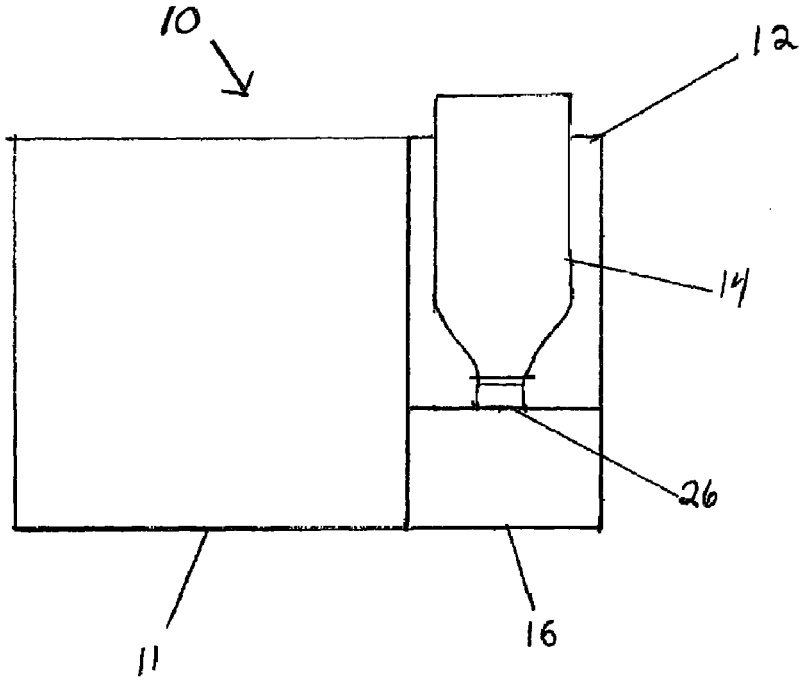
FIG. 1 depicts a partial sectional view of an appliance of the present disclosure.

Referring now to the drawing figures in which like reference designators refer to like elements, there is shown in FIG. 1 an appliance 10 of the present disclosure. The appliance 10 includes an operational portion 11 and a bottle receiving portion 12, where the bottle receiving portion 12 is configured to receive a water bottle 14 therein. The bottle 14 can be positioned in the bottle receiving portion 12 in either an inverted or upright (not shown) position.

Figure 2:
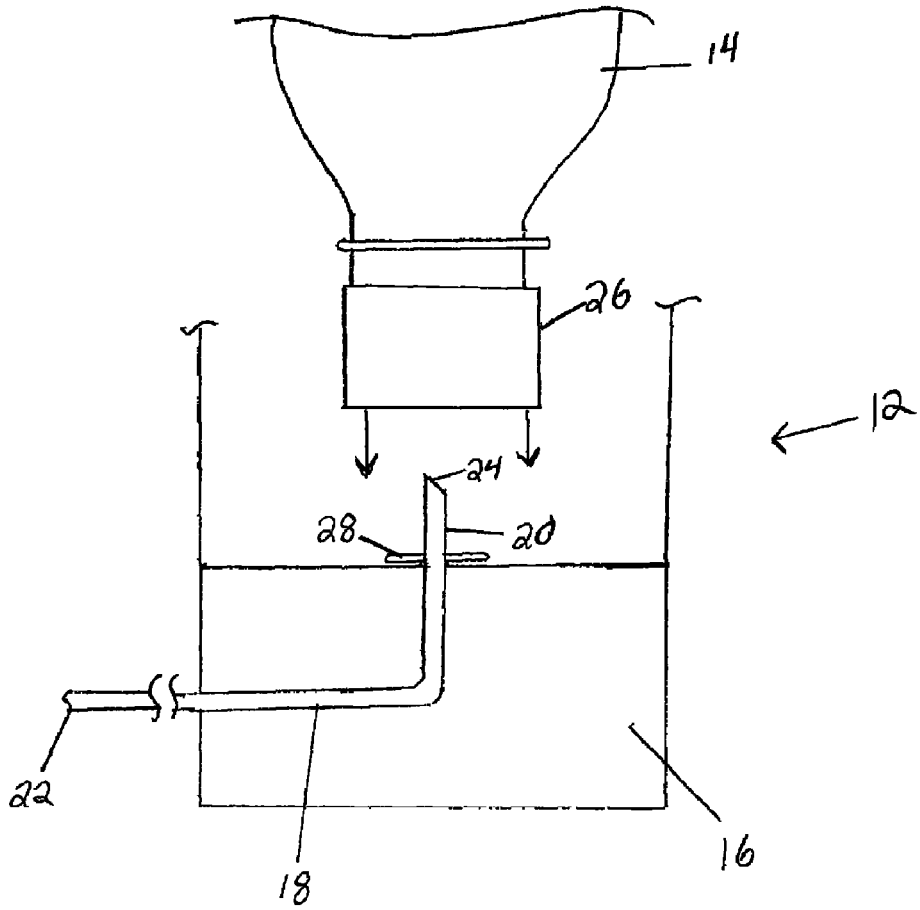
FIG. 2 depicts a partial sectional view of a bottle receiving portion of the appliance of FIG. 1.

Referring to FIG. 2, the bottle receiving portion 12 includes a base 16 for positioning the bottle 14 thereon. A hollow water supply conduit 18 is positioned in the base 16. The conduit 18 includes a first end 20, extending up through the base 16, and a second end 22 configured to supply water to the operational portion 11 of the appliance 10. The first end 20 of the conduit includes a piercing member 24. The piercing member 24 is designed to pierce the bottle 14 forming a seal between the bottle 14 and the first end 20 of the conduit 18, allowing water to flow through the conduit 18. The bottle receiving portion 12 can have a sufficient depth so as to substantially prevent a user's hand from contacting the piercing member 24.

Figure 3:
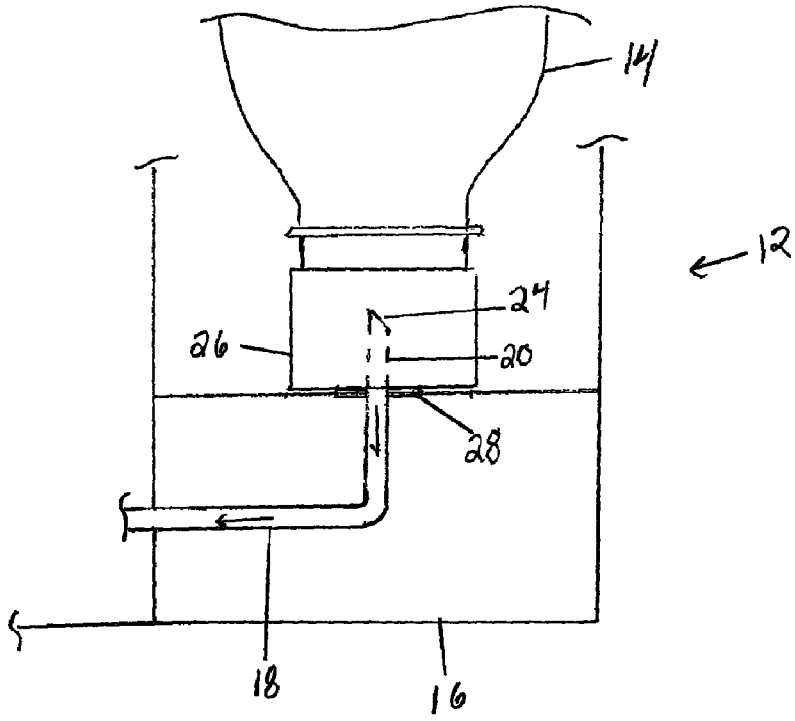
FIG. 3 depicts a partial sectional view of the bottle receiving portion of the appliance of FIG. 1 including a bottle positioned thereon.

Referring also to FIG. 3, when a bottle 14 is positioned in an inverted position in the bottle receiving portion 12, the cap 26 of the bottle 14 is aligned with the piercing member 24. As the bottle 14 is moved toward the base 16, the piercing member 24 pierces the cap 26 of the bottle 14. The conduit 18 provides a fluid path therethrough for the water to flow from the bottle 14 to the operational portion 11 of the appliance 10.

In a similar manner, the bottle 14 can be positioned in an upright position in the bottle receiving portion 12, the bottom of the bottle 14 being aligned with the piercing member 24. As the bottle 14 is moved toward the base 16, the piercing member 24 pierces the bottom of the bottle 14. The conduit 18 provides a path therethrough for the water to flow from the bottle 14 to the operational portion 11 of the appliance 10.

In an embodiment, a gasket 28 is positioned about the first end 20 of the conduit 18. As the bottle 14 is moved toward the base 16, the gasket 28 is sandwiched between the bottle 14 and the base 16. The gasket 28 provides a seal about the conduit 18 and between the water bottle 16 and the base 16, thus substantially preventing a leakage of water.

In another embodiment, a breathing tube can be inserted into the bottle 14. The breathing tube allows air to enter the bottle 14, equalizing the pressure between the inside and outside of the bottle 14. In this manner, the water can flow more freely from the bottle 14 to the operational portion 11 of the appliance 10.

Figure 4:
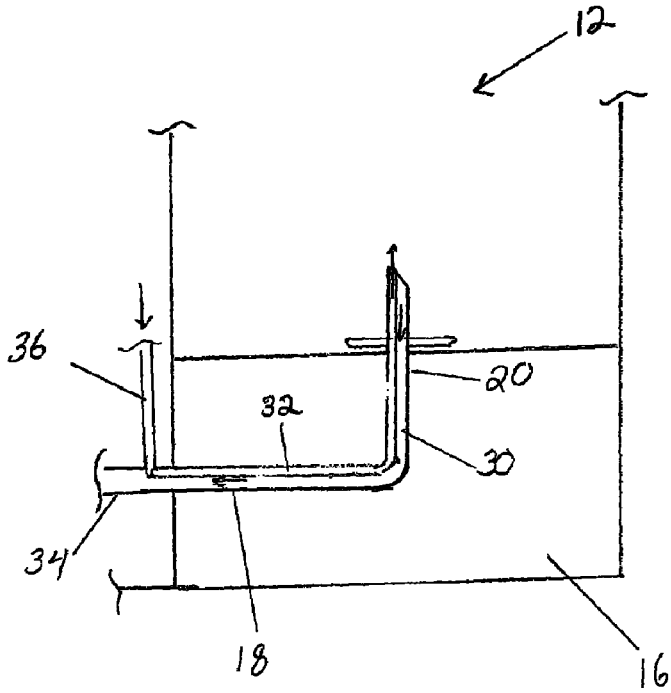
FIG. 4 depicts a partial sectional view of the bottle receiving portion of the appliance of FIG. 1 including a bifurcated conduit.
Figure 5:
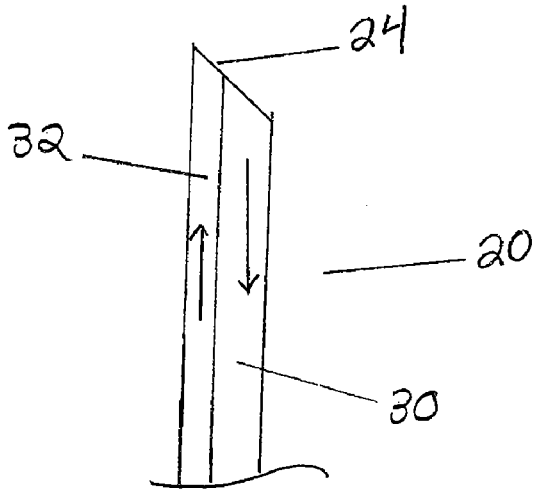
FIG. 5 depicts a partial sectional view of the bifurcated conduit of FIG. 4.

Referring to FIGS. 4-5, the first end 20 of the conduit 18 is bifurcated, defining a first and second path 30 and 32. The second end 22 of the conduit 18 separates into a water supply line 34 and breathing tube line 36. The breathing tube line 36 is spaced above the water supply line 34, allowing for the air to enter the bottle 14 through the breathing tube line 36 and the water to exit through the water supply line 34. The first path 30 is further defined through the water supply line 34, such that water travels through the first path 30 to the operational portion 11 of the appliance 10. The second path 32 is further defined through the breathing tube line 36, such that air can enter the bottle 14 through the breathing tube line 36, thereby equalizing the pressure.

Figure 6:
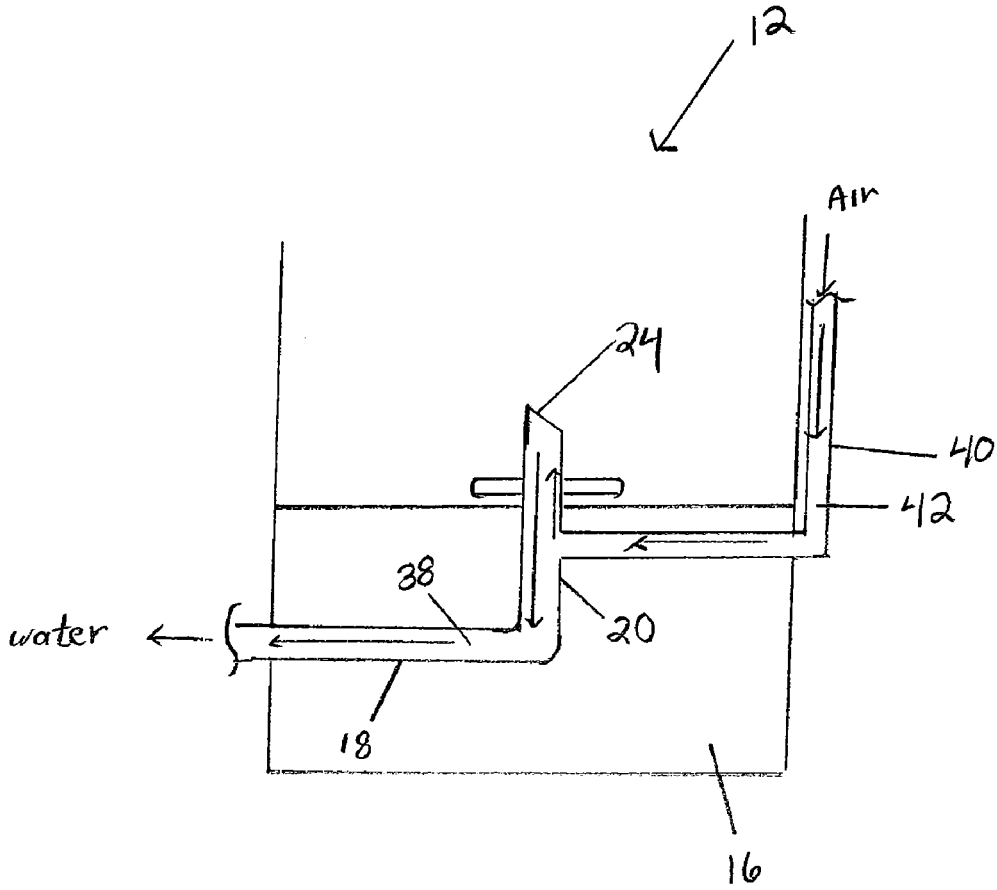
FIG. 6 depicts a partial sectional view of the bottle receiving portion of the appliance of FIG. 1 including a breathing tube.

Referring to FIG. 6, and as noted above, the conduit 18 is positioned in the base 16, where the first end 20 extends up through the base 16, and a second end 22 is configured to supply water to the operational portion 11 of the appliance 10. As such, a fluid path 38 is defined through the conduit 18. A breathing tube 40 is connected to the first end 20 of the conduit 18, such that the breathing air path 42 is defined. In this manner, air can enter the bottle 14 through the breathing tube 40, thereby equalizing the pressure.

Figure 7:
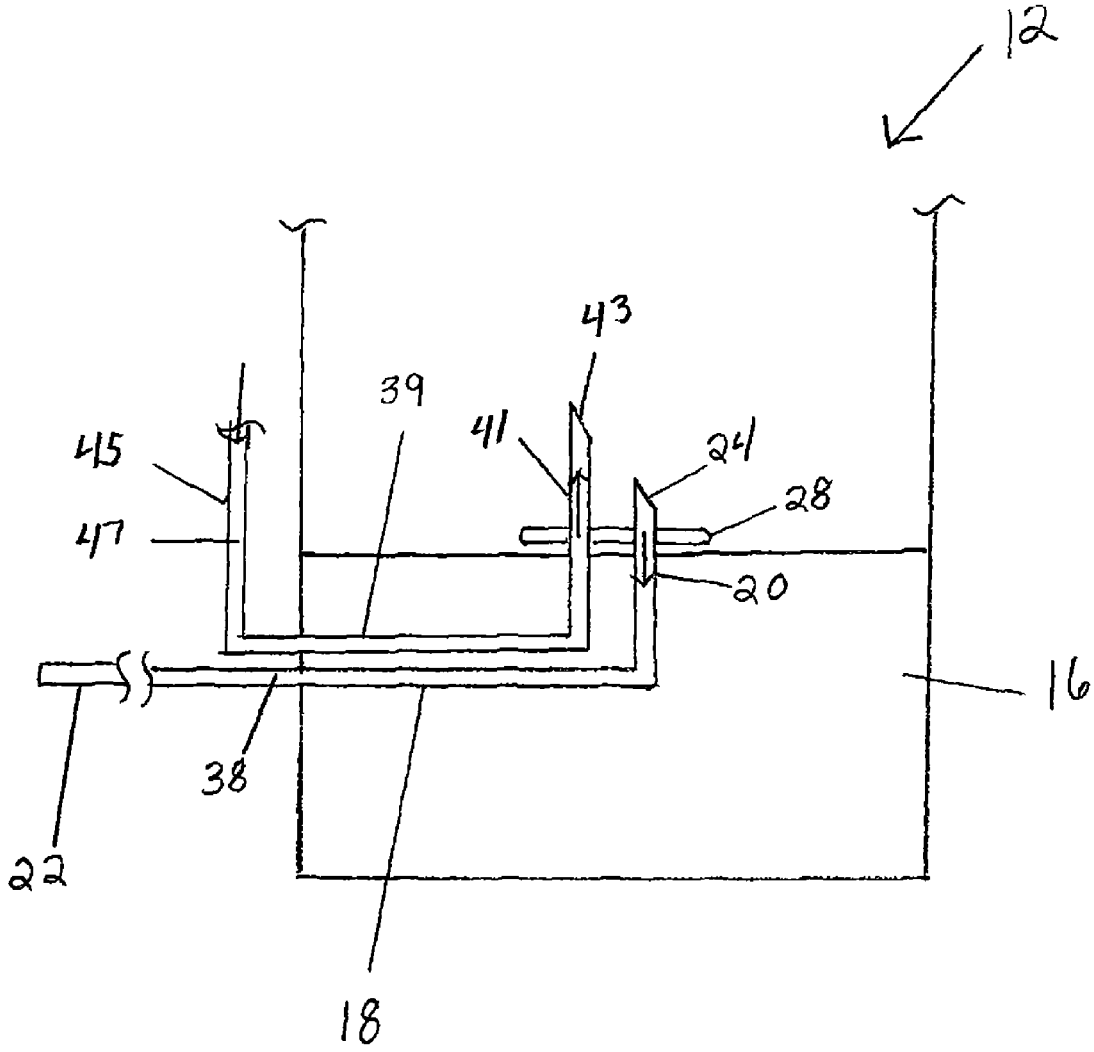
FIG. 7 depicts a another partial sectional view of the bottle receiving portion of the appliance of FIG. 1 including a breathing tube.

Referring to FIG. 7, and as noted above, the conduit 18 is positioned in the base 16, where the first end 20 extends up through the base 16, and a second end 22 is configured to supply water to the operational portion 11 of the appliance 10. As such, a fluid path 38 is defined through the conduit 18. A breathing tube 39 is positioned in the base 16, and has a first end 41 and a second end 45, defining a breathing air path 47. The first end 41 of the breathing tube 39 extends up through the base 16, and includes a piercing member 43. The second end 45 is configured to allow for the entry of outside air in the breathing tube 39, such that the air travels along the breathing air path 47 into the bottle 14. Air can enter the bottle 14 through the breathing tube 39, thereby equalizing the pressure. It is contemplated that the piercing member 43 of the breathing tube 39 is at a greater vertical distance from the base 16 then the piercing member 24 for the conduit 18.

Figure 8:
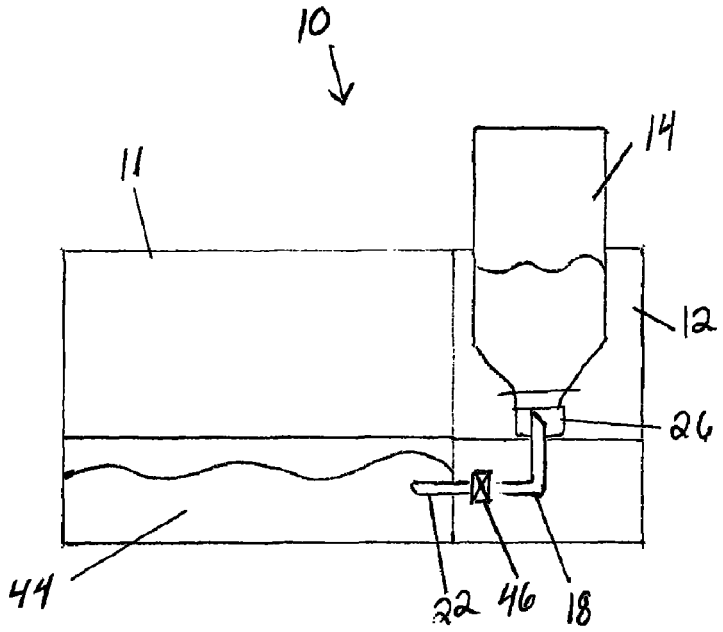
FIG. 8 depicts a partial sectional view of the bottle receiving portion of the appliance of FIG. 1 including a fluid reservoir.

Referring to FIG. 8, the operational portion 11 of the appliance 10 includes a fluid reservoir 44, where the second end 22 of the conduit is positioned in the fluid reservoir 44. The water flows from the bottle 14, through the conduit 18, out the second end 22 and into the reservoir 44, where it is stored for use.

A one-way check valve 46 can be positioned in-line with the conduit 18. The check valve 46 prevents water from enter the conduit 18 from the reservoir 44. The check-valve 46 can be opened when the pressure in the conduit 18 is greater the pressure in the reservoir 44, thus permitting water to flow from the bottle 14 into the reservoir 44.

When the pressure in the reservoir 44 is greater then the pressure in the conduit 18, such as when the reservoir 46 is full, the check-valve 46 is closed preventing water from entering the reservoir 46.

Figure 9:
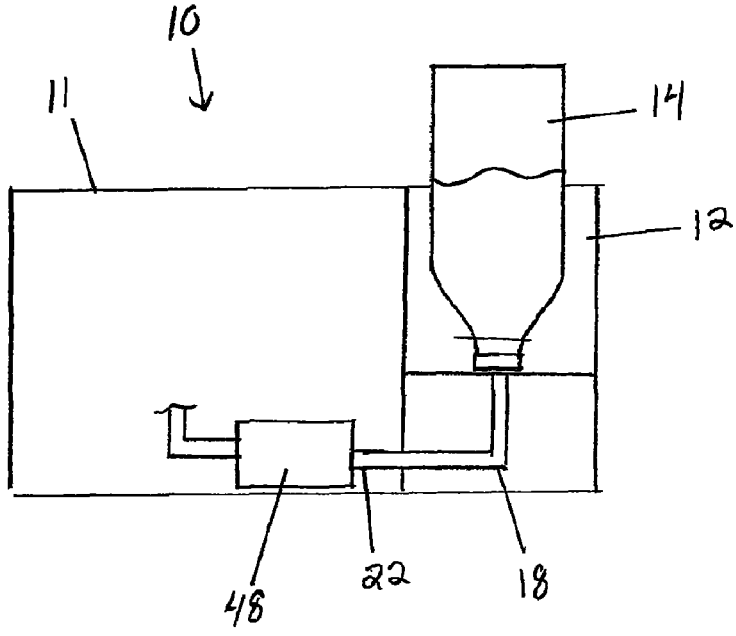
FIG. 9 depicts a partial sectional view of the bottle receiving portion of the appliance of FIG. 1 including a fluid pump.

Referring to FIG. 9, the operational portion 11 of the appliance 10 can include a fluid pump 48. The fluid pump 48 is connected to the second end 22 of the conduit 18. An operation of the fluid pump 48 draws water from the bottle 14 into the operational portion 11 of the appliance 10 as needed.

Figure 11:
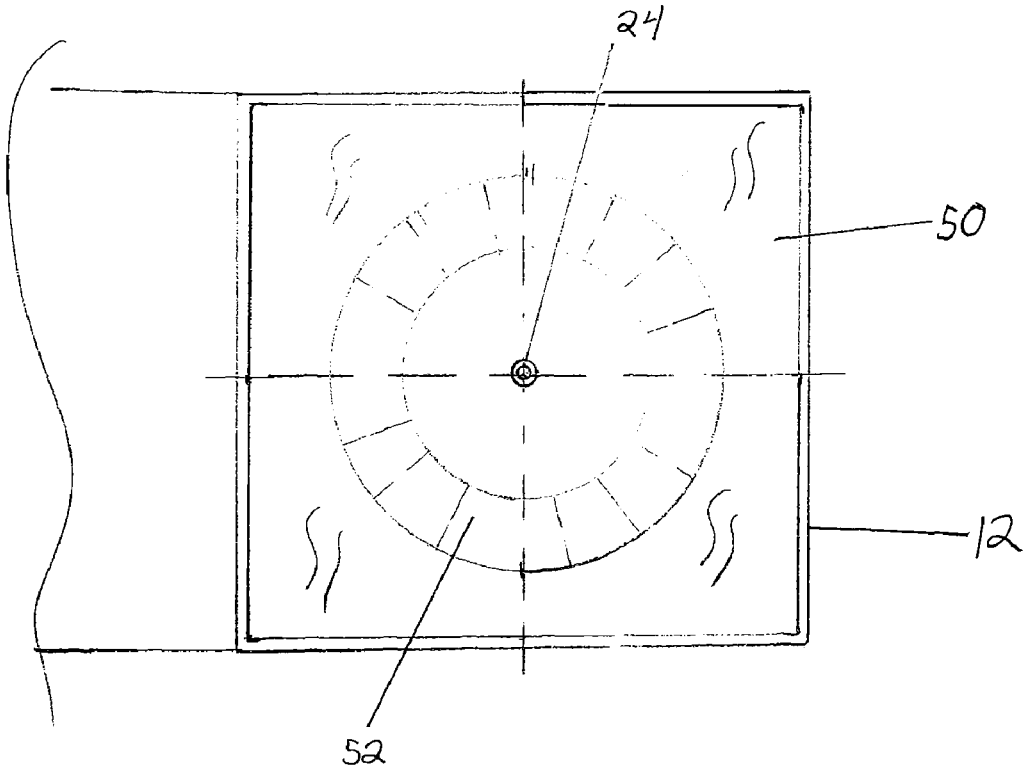
FIG. 11 depicts a top view of the bottle support member of FIG. 10.
Figure 10:
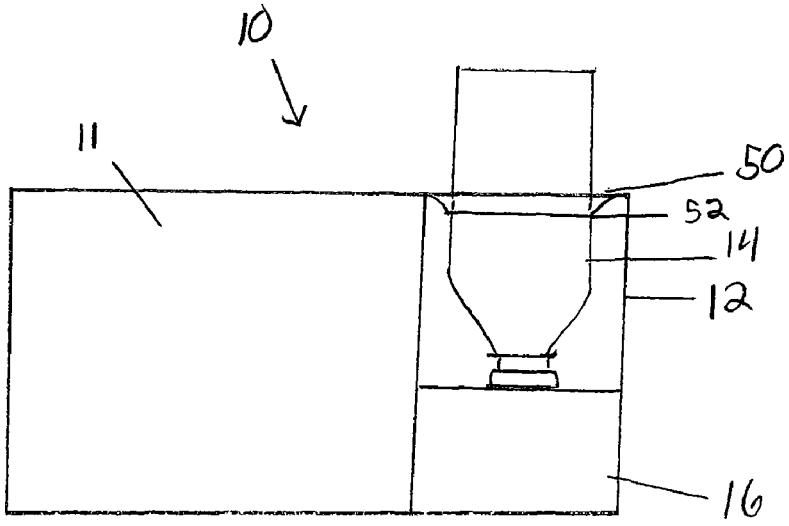
FIG. 10 depicts a partial sectional view of the bottle receiving portion of the appliance of FIG. 1 including a bottle support member.

Referring to FIGS. 10 and 11, a support member 50 is positioned in the bottle receiving portion 12. The support member 50 includes a center ring 52 configured for receiving the bottle 14 therethrough, where the centering ring 52 engages the outside surface of the bottle 14, supporting the bottle in a substantially vertical position. The centering ring 52 is centered over the piercing member 24, thus aiding in the alignment of the bottle 14 with the piercing member 24.

The support member 50 and center ring 52 can be made of an elastic material. In this manner, the center ring 52 can expand to accommodate different size bottles 14.

It is contemplated that different sized bottles 14 can be positioned in the bottle receiving portion 12, such as 12 oz., 20 oz., 32 oz., ½ liter, 1 liters, and the like.

The operational portion 11 of the applicant 10, can be any appliance which utilizes water in its function, including, humidifiers, vaporizers, coffeemakers, tea makers, dental water jets, and the like. The functional and operational structures of these appliances are known in the art, and as such, are not described herein. The above is not considered to be a comprehensive list, and other appliances are contemplated.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An appliance, comprising;

an operational portion; and a bottle receiving portion including a water conduit defining a water path between a water bottle and the operational unit and an air conduit defining an air path between the water bottle and an atmosphere, wherein the water conduit includes a first end having a piercing member for piercing the water bottle, and a second end in fluid communication with the operational portion, wherein the first end of the water conduit and a first end of the air conduit are adjacently positioned forming the piercing member for piercing the water bottle, and wherein the water bottle is removably positionable in the bottle receiving portion to supply water to the operational portion.

2. An appliance as set forth in claim 1, the bottle receiving portion including a base, wherein the first end of the water conduit extends through the base.

3. An appliance as set forth in claim 2, further comprising a gasket positioned about the first end of the water conduit, proximal to the base.

4. An appliance as set forth in claim 1, wherein a valve is positioned on the second end of the water conduit.

5. An appliance as set forth in claim 1, wherein the operational portion includes a fluid reservoir, the second end of the water conduit in fluid communication with the fluid reservoir.

6. An appliance as set forth in claim 1, wherein the operational portion includes a fluid pump, the second end of the water conduit in fluid communication with the fluid pump.

7. An appliance as set forth in claim 1, further comprising a support member positioned in the bottle receiving portion, the support member configured to receive the water bottle therethourgh.

8. An appliance as set forth in claim 7, wherein the support member is made of an elastic material.

9. An appliance as set forth in claim 8, wherein the support member is expandable to receive different size water bottles.

10. An appliance as set forth in claim 1, wherein the operational portion is a humidifier, vaporizer, coffeemaker, tea maker, or dental water jet.

11. An appliance, comprising;

an operational portion;

a bottle receiving portion having a base;

a water conduit defining a fluid path, the water conduit including a first end have a piercing member extending through the base and a second end in fluid communication with the operational portion, wherein a water bottle is removably positionable in the bottle receiving portion such that the piercing member pierces the water bottle to supply water to the operational portion; and an air conduit defining an uninterrupted air path between the water bottle and the atmosphere, wherein the first end of the water conduit and a first end of the air conduit are adjacently positioned forming the piercing member for piercing the water bottle.

12. An appliance as set forth in claim 11, further comprising a support member positioned in the bottle receiving portion, the support member configured to receive the water bottle therethourgh, wherein the support member is made of an elastic material and is expandable to receive different size water bottles.

* * * * *